US007393002B2

(12) United States Patent
Thomas et al.

(10) Patent No.: US 7,393,002 B2
(45) Date of Patent: Jul. 1, 2008

(54) ADJUSTABLE DEVICE FOR AN ACCESSORY SUCH AS A FRONT STOP OF A SKI BINDING

(75) Inventors: Gérard Thomas, Urzy (FR); Patrice Viodet, La Fermeté (FR)

(73) Assignee: Look Fixations S.A., Nevers (FR)

( * ) Notice: Subject to any disclaimer, the term of this patent is extended or adjusted under 35 U.S.C. 154(b) by 170 days.

(21) Appl. No.: 11/253,030

(22) Filed: Oct. 18, 2005

(65) Prior Publication Data

US 2006/0091644 A1 May 4, 2006

(30) Foreign Application Priority Data

Oct. 28, 2004 (FR) ..... 04 11479

(51) Int. Cl.
*A63C 9/22* (2006.01)

(52) U.S. Cl. ..... 280/613; 280/634

(58) Field of Classification Search ..... 280/613, 280/617, 623, 633, 634, 636, 11.26
See application file for complete search history.

(56) References Cited

U.S. PATENT DOCUMENTS 3,807,748 A * 4/1974 Ramillon ..... 280/633
4,524,990 A * 6/1985 Svoboda et al. ..... 280/633
4,620,719 A 11/1986 Stritzl
4,681,339 A * 7/1987 Himmetsberger et al. ... 280/633
4,817,981 A * 4/1989 Desbiolles et al. ..... 280/633
5,344,179 A * 9/1994 Fritschi et al. ..... 280/618
5,738,364 A 4/1998 Zotter et al.

FOREIGN PATENT DOCUMENTS

DE 103 34 840 A1 * 11/2004
FR 2 742 345 6/1997
FR 2 775 195 8/1999

* cited by examiner

*Primary Examiner*—Frank B Vanaman
(74) *Attorney, Agent, or Firm*—Frommer Lawrence & Haug LLP; Ronald R. Santucci

(57) ABSTRACT

Device for adjustable fixing of an accessory on a board for gliding comprising a base, comprising locations for fixing the accessory and receiving a bar having a toothed part capable of a positioning in a complementary toothed part integral with the board for gliding, wherein the bar is mounted so as to be movable in rotation on the base about an axis, comprises, on either side of this axis, the toothed part and an end, and which comprises a knob capable of occupying two different positions, comprising a cam surface that interacts with the end of the bar such that a first position of the knob corresponds to a low position of the toothed part and a second position corresponds to a high position of the toothed part.

10 Claims, 3 Drawing Sheets

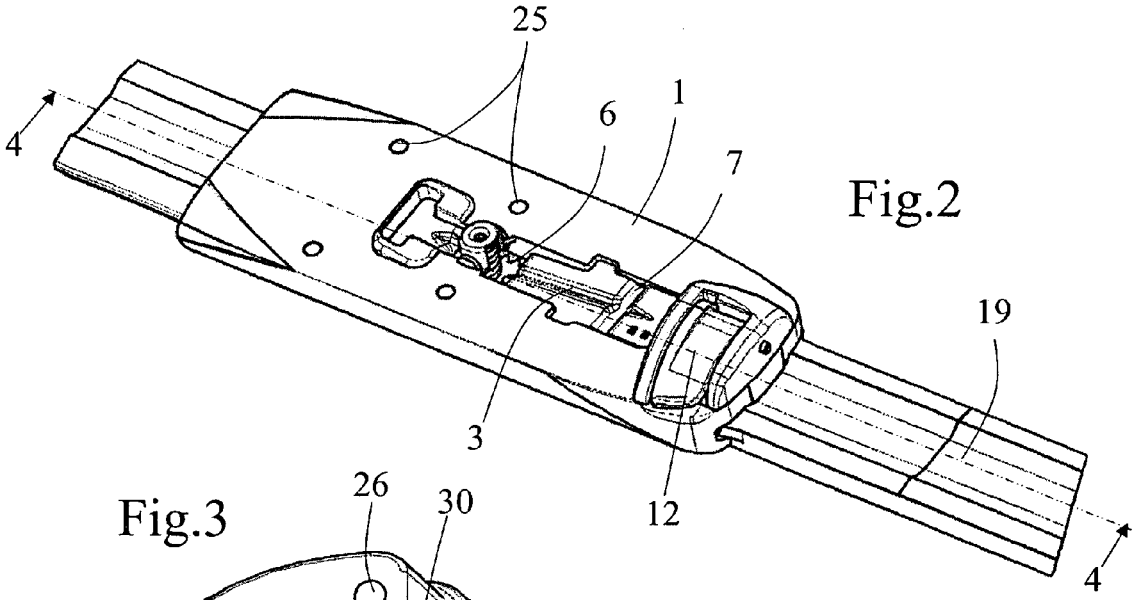
Fig.2
Fig.3
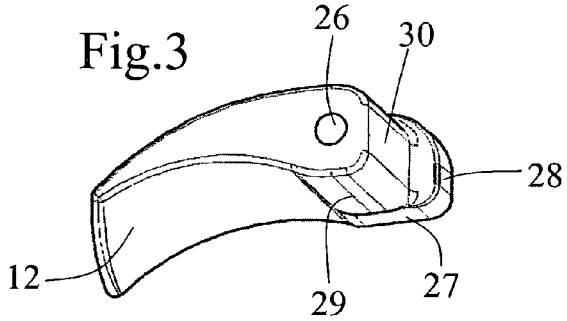
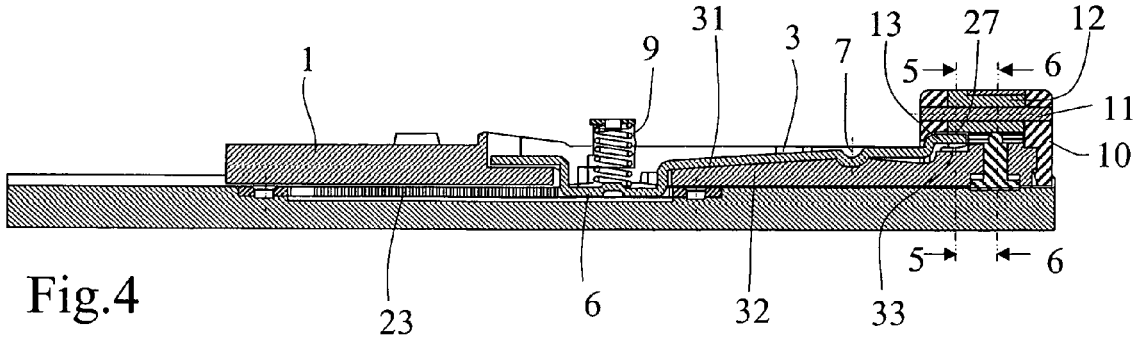
Fig.4

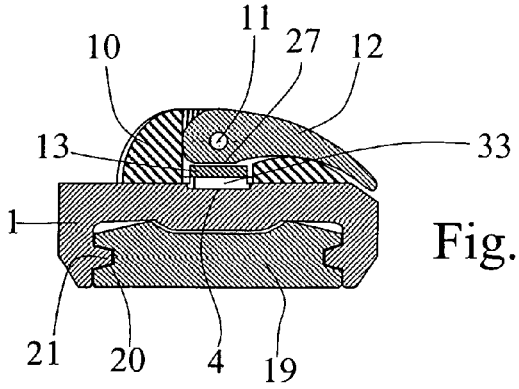
Fig.5
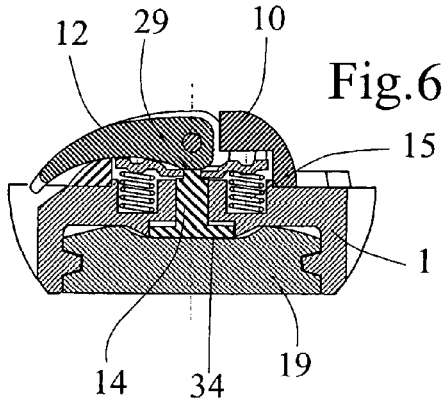
Fig.6
Fig.7
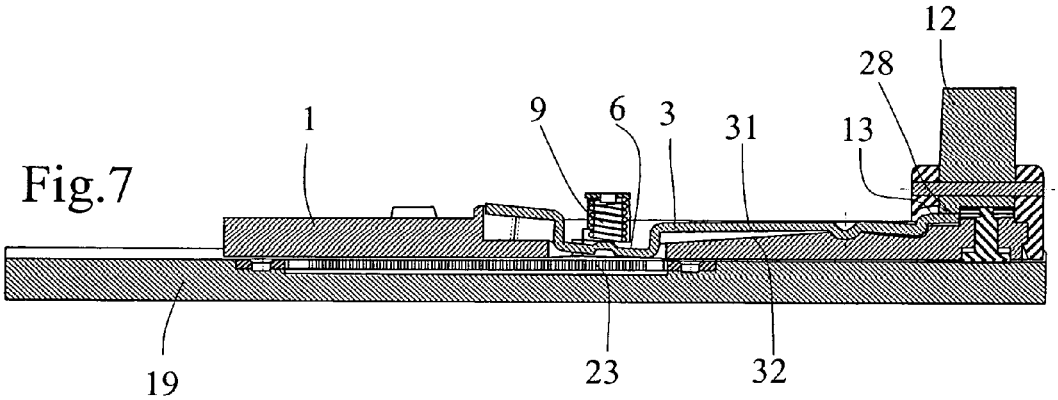
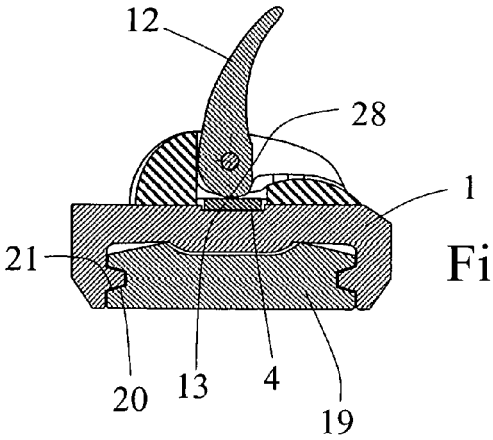
Fig.8
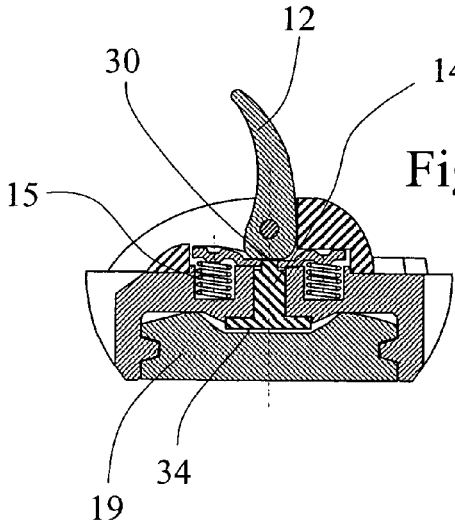
Fig.9

ADJUSTABLE DEVICE FOR AN ACCESSORY SUCH AS A FRONT STOP OF A SKI BINDING

This application claims priority benefits from French Patent Application No. 04 11479 filed Oct. 28, 2004.

FIELD OF THE INVENTION

The invention relates to a device for adjustable fixing of an accessory on a board for gliding, suited particularly for fixing, on a ski, a front stop of a ski-boot binding device, allowing its longitudinal adjustment.

BACKGROUND OF THE INVENTION

Various devices are known that allow adjustment of the longitudinal position of a front stop of a ski-boot binding device with a view to adapting the binding to various boot lengths. A common prior-art solution is based on guide rails positioned on the ski, that include a toothed part on which a complementary toothed part integral with the front stop of the ski binding is positioned. When these toothed parts are released, the stop can be adjusted by being slid longitudinally along the guide rails. However, existing solutions all have drawbacks, including:

- they require a tool for releasing the toothed parts. This tool has to be inserted via an opening and held in position during adjustment. In this case, solutions are not user-friendly and are impractical for rapid adjustment operations under any conditions such as, for example, on a ski trail, where the required specific tool is not always available; and/or
- there is play present at the join between the two toothed parts, even in the configuration envisaged for skiing, which greatly diminishes control over guiding the ski; and/or
- they are not fail-safe, i.e. they can give rise to accidental changes in setting during their use, which is dangerous because it may cause the skier to fall; and/or
- they are complicated because they are based either on a large number of elements or on elements that are complicated to manufacture or to assemble; and/or
- lastly, they are sometimes unattractive in appearance because unattractive mechanical elements can be seen.

SUMMARY OF THE INVENTION

There is now a need for another solution for a device for adjusting an accessory on a board for gliding.

A general object of the present invention is to propose a device for adjustable fixing of an accessory on a board for gliding that does not have the above drawbacks.

More precisely, a first object of the invention consists in proposing a device for adjustable fixing of an accessory on a board for gliding that is user-friendly and easy to use under all conditions.

A second object of the invention consists in proposing a device for adjustable fixing of an accessory on a board for gliding allowing play-free fixing.

A third object of the invention consists in proposing a device for adjustable fixing of an accessory on a board for gliding allowing fail-safe fixing.

A fourth object of the invention consists in proposing a device for adjustable fixing of an accessory on a board for gliding that is simple and easy to fit.

A fifth object of the invention consists in proposing a device for adjustable and esthetically pleasing fixing of an accessory on a board for gliding.

The invention is based on a device for adjustable fixing of an accessory on a board for gliding comprising a base, comprising locations for fixing the accessory and receiving a bar having a toothed part capable of a positioning in a complementary toothed part integral with the board for gliding, the bar being mounted so as to be movable in rotation on the base about an axis, comprising, on either side of this axis, the toothed part and an end, and comprising a knob capable of occupying two different positions, comprising a cam surface that interacts with the end of the bar such that a first position of the knob corresponds to a low position of the toothed part and a second position corresponds to a high position of the toothed part.

The bar may be arranged in the longitudinal direction of the base, the toothed part being located substantially in the central part of the base and the end of the bar and the knob being located toward one end of the base.

The knob may have a cam surface that comprises a first part in contact with the end of the bar when the toothed part and the knob occupy a low position and a second part further away from the axis of rotation of the knob, which gives rise to a downward displacement of the end of the bar when the knob is in its second, high position, corresponding to a high position of the toothed part.

The device may comprise a spring mounted on the base and exerting a force on the bar that tends to hold its toothed part in the low position.

The knob may comprise a second cam surface of which two parts are in contact with a piston of the base such that the piston exerts a downward pressure when the knob occupies its low position in order to immobilize play of the base.

The base may comprise at least one location for receiving a front stop of a ski binding, and the knob may be positioned toward the rear end of the base designed to receive a ski boot.

The invention also relates to a front stop of a ski binding that comprises a device for adjustable fixing of its longitudinal position according to the invention.

The invention also relates to the assembly composed of the device for fixing an accessory on a board for gliding described previously and to an element designed to be securely fixed to the board for gliding and comprising a toothed part corresponding to the toothed part of the bar.

Lastly, the invention also relates to a ski that comprises a device for adjustable fixing of an accessory as described above.

BRIEF DESCRIPTION OF THE DRAWINGS

An embodiment is described below by way of example with reference to the appended drawing, in which:

FIG. 2 shows a non-exploded perspective view of the embodiment of FIG. 1;

FIG. 3 shows a perspective front view of the knob of one embodiment of the invention;

FIG. 4 shows a sectional view on the axis 4-4 of the device of the invention in a first position;

FIG. 5 shows a sectional view on the axis 5-5 of the device of the invention in a first position;

FIG. 6 shows a sectional view on the axis 6-6 of the device of the invention in a first position;

FIG. 7 shows a sectional view on the axis 4-4 of the device of the invention in a second position;

FIG. 8 shows a sectional view on the axis 8-8 of the device of the invention in a second position;

FIG. 9 shows a sectional view on the axis 9-9 of the device of the invention in a second position.

In the various figures, the same reference numerals will be used for corresponding elements.

DESCRIPTION OF THE PREFERRED EMBODIMENT

Figure 1:
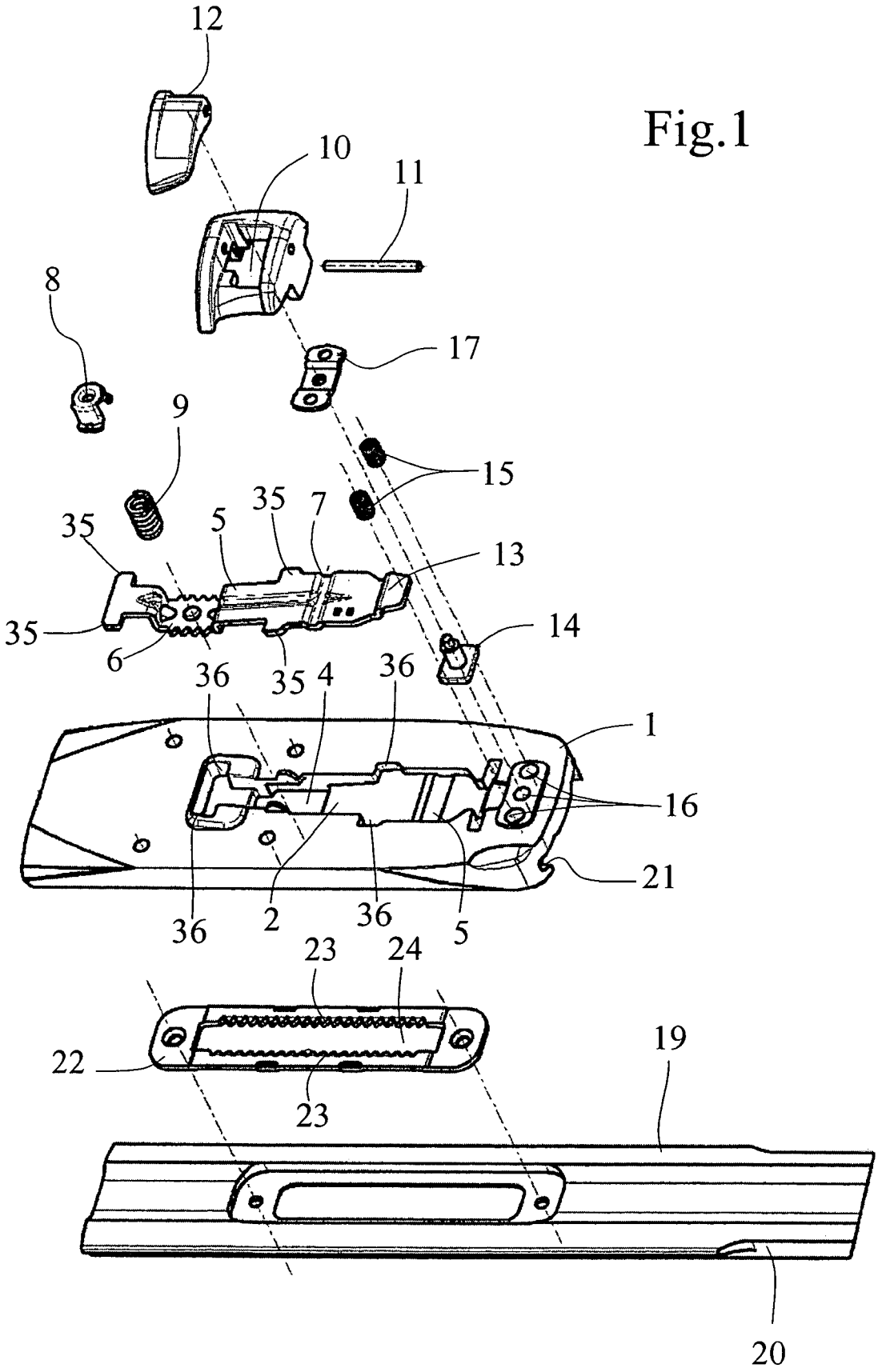
FIG. 1 shows an exploded perspective view of one embodiment of the invention.

As illustrated in FIG. 1, the device according to one embodiment of the invention comprises an elongate base 1, comprising a location 2 in which a longitudinal bar 3 is positioned. The location 2 is composed of an opening 4 and of a location 5 for receiving, respectively, a toothed part 6 of the bar 3 and a link with a bar part in the form of an arc of a circle. This link allows the bar 3 to be movable in rotation about an axis 7 on the location 5 relative to the base 1, allowing the toothed part 6 of the bar, which is located in a lower plane and substantially parallel to the plane of the rest of the bar 3, to traverse the opening 4 in its lowest position so that it can be fixed in a complementary toothed part integral with the board for gliding, which will be described below, or to occupy a high position within the opening 4, in which it is released from the complementary toothed part. This mechanism will be described in greater detail with reference to FIGS. 4 to 9.

The base 1 also comprises a means 8 for holding a spring 9 that has the effect of exerting a downward force on the toothed part 6 of the bar in order to push it back into its low position. It also comprises a housing 10 in which, mounted movably in rotation about an axis 11, there is a knob 12 whose first function is to act on the end 13 of the bar in order to enable it to move from its low position to its raised position.

Lastly, the device comprises a blocking piston 14, surrounded by two return springs 15, all three mounted in three openings 16 of the base 1. The assembly is surmounted by a spring plate 17 connected to the blocking piston 14 and interacting with the knob 12.

FIG. 2 illustrates the adjustment device described previously, mounted securely on a board for gliding by means of an element 19 integral with the board for gliding and comprising slides 20 on which the base 1 is able to slide by virtue of corresponding longitudinal slides 21. The element 19 also comprises a part 22 comprising two lateral rows 23 of teeth. These teeth are in a plane parallel to the element 19 and oriented transversely to the slides 20, facing a central opening 24 located between the two rows 23 of teeth. The dimensions of the central opening 24 correspond to the toothed part 6 of the bar 3, the teeth of which may thus be accommodated between the teeth of the rows 23 in order to fix the base 1 on the element 19, preventing longitudinal sliding of the base 1 relative to the board for gliding. The base 1 comprises locations 25 suitable for the fixing of an accessory such as a front stop of a ski binding, for example.

FIG. 3 shows the knob 12 that comprises an opening 26 for receiving an axis 11 and being mounted in rotation about said axis. Its specially adapted shape allows it to be rotated manually about said axis 11. It comprises a first cam surface comprising a first part 27 and a second part 28 that are designed to interact with the end 13 of the bar 3. It also comprises a second cam surface comprising a first part 29 and a second part 30 that are designed to interact with the spring plate 17.

FIGS. 4 to 6 illustrate the device in a first position of the knob 12, which corresponds to the position of fixing of the base 1. In this configuration, the knob 12 is in its low position, folded down on the base 1, and its cam surface 27 is in contact with the end 13 of the bar 3. In this position, the end 13 of the bar occupies a raised position and the spring 9 holds the toothed part 6 in its low position, in which it traverses the opening 4 of the base in order to be received in the teeth of the rows 23 of the element 19 on the board for gliding, thereby preventing any longitudinal movement of the base 1. In this stable position, the top part 31 of the bar 3 is in contact with a corresponding part 32 of the base over a length that is approximately one-third of the total length of the bar, which guarantees precise positioning of the bar 3. Furthermore, this part has a slight inclination that enables its end 13 to have a potential freedom of movement relative to the base 1, which does not follow this inclination toward its end and thus frees a space 33 between the end 13 of the bar and its housing 4 provided in the base 1.

FIG. 6 illustrates the positioning of the second cam surface of the knob 12 in this low position, in which its cam surface 29 is in contact with the plate 17 and the piston 14, pushing it back into a low position such that the base 34 of the piston abuts against the element 19. In this position, the piston 14 also prevents relative movements between the base 1 and the element 19 and fulfills a play-blocking function, which is important to guarantee a satisfactory link between the stop and the ski, necessary for precise guiding of the ski.

The bar 3 comprises wider parts 35 that are accommodated in locations 36 of the same size as the housing 4 of the base 1. This has the effect of preventing any relative longitudinal movement between the bar 3 and the base 1. Thus, fixing of the bar 3 in the element 19 also fixes the base 1.

FIGS. 7 to 9 illustrate the other extreme—totally raised—position of the knob 12, in a configuration allowing longitudinal adjustment of the base 1 on the ski. In this position, the cam surface 28 of the knob bears on the end 13 of the bar 3. As this surface 28 is further from the axis of rotation 11 of the bar than the surface 27, the end 13 of the bar is pushed downward and traverses the space 33 until it bears on the housing 4 of the base 1. By means of a lever effect, this displacement gives rise to the rotation of the bar 3 about the axis 7, which raises its parts 31 and 6, opposing the pressure force of the spring 9. As may be seen in FIG. 7, the toothed part 6 is then sufficiently raised to completely clear its teeth of the rows 23. In this position, the base 1 then becomes longitudinally movable along the slides 20, 21 vis-à-vis the element 19. The form of the cam surface 28 enables the knob 12 to retain this position stably.

FIG. 9 shows the contact between the second cam surface 30 of the knob 12 and the piston 14. As this second part 30 of the second cam surface is closer to the axis of rotation 11 than the first part 29 of the second cam surface, the piston 14 and the plate 17 occupy a higher position, pushed back upward by the springs 15, thus releasing a small space between the base 34 of the piston and the element 19 with a view to not impeding the longitudinal displacement of the base 1.

The toothed part 6 of the base 1 is substantially at the center of the base 1, which enables the base 1 to better conceal the fixing device integral with the board for gliding, i.e. the element 19 and its toothed part 22, which is not esthetically attractive. Furthermore, the knob 12 is positioned toward the rear of the base 1 in the longitudinal direction, which allows, in the case of an application with a front stop in the locations 25, the positioning of a ski boot over the knob 12, giving rise to a blocking and holding effect in the event of the knob being in its low position and preventing its accidental opening.

Finally, this solution presents the following advantages:

it functions with a simple knob that is easy to manipulate and is thus a user-friendly solution;

it eliminates any play in the configuration of fixing and using the board for gliding and guarantees satisfactory control of guiding of the board for gliding;

the same knob fulfills two functions: first, of releasing or meshing the teeth together for a changeover to the configuration of position adjustment or otherwise and, second, of eliminating play;

the knob is located on one end of the base, opposite the location envisaged for an accessory. If the accessory is a front stop, this solution allows the positioning of the boot over the knob in the low position, which prevents its unintentional actuation, which would have the undesired effect of a change in the setting of the binding during use of the ski;

the solution includes few pieces and is simple to fit;

the solution allows travel of the base 1 that receives the accessory that, in all its positions, better conceals the fixing system integral with the board for gliding, promoting an attractive appearance.

The invention claimed is:

1. A device for adjustable fixing of an accessory on a board for gliding, comprising:

(i) a base (1) having a central part and a first and second end, wherein the base (1) comprises a location (25) for fixing the accessory and a location (2);

(ii) a bar (3) comprising a toothed part (6) that is capable of a positioning in a complimentary toothed part integral with the board for gliding, and comprising an end (13); wherein the bar (3) is received by the base (1) at location (2), wherein the bar (3) is mounted so as to be movable in rotation on the base (1) about an axis (7), and wherein the toothed part (6) and the end (13) of the bar (3) are on different sides of the axis (7);

(iii) a knob (12) capable of occupying two different positions, wherein the knob (12) comprises a cam surface that interacts with the end (13) of the bar (3) such that a first position of the knob (12) corresponds to a low position of the toothed part (6) and a second position corresponds to a high position of the toothed part (6).

2. The device for adjustable fixing of an accessory on a board for gliding as claimed in claim 1, wherein the bar (3) is arranged in the longitudinal direction of the base (1), the toothed part (6) being located substantially in the central part of the base (1), and the end (13) of the bar (3) and the knob (12) being located toward the second end of the base (1).

3. The device for adjustable fixing as claimed in claim 2, wherein the accessory affixed at location (25) is a front stop of a ski binding, and wherein the knob is positioned toward the second end of the base (1) designed to receive a ski boot.

4. The device for adjustable fixing of an accessory on a board for gliding as claimed in claim 1, wherein the knob (12) has a cam surface comprising:

(i) a first part (27) in contact with the end (13) of the bar (3) when the toothed part (6) and the knob (12) occupy a low position; and (ii) a second part (28) further away from the axis (11) of rotation of the knob (12), which gives rise to a downward displacement of the end (13) of the bar (3) when the knob (12) is in its second position, corresponding to a high position of the toothed part (6).

5. The device for adjustable fixing of an accessory on a board for gliding as claimed in claim 1, which further comprises a spring (9) mounted on the base (1) and exerting a force on the bar (3) that tends to hold its toothed part (6) in the low position.

6. The device for adjustable fixing of an accessory on a board for gliding as claimed in claim 1, wherein the knob (12) comprises a second cam surface of which two parts (29, 30) are in contact with a piston (14) of the base (1) such that the piston (14) exerts a downward pressure when the knob (12) occupies its first position in order to immobilize play of the base (1).

7. A front stop of a ski binding which comprises a device for adjustable fixing of its longitudinal position as claimed in claim 1.

8. A ski that comprises a device as claimed in claim 7.

9. A device for fixing an accessory on a board for gliding which comprises a device as claimed in claim 1 and an element (19) designed to be securely fixed to the board for gliding and comprising a toothed part (22) corresponding to the toothed part (6) of the bar (3).

10. A ski that comprises a device as claimed in claim 1.

* * * * *